US005524336A

United States Patent [19]

Gibas

[11] Patent Number: 5,524,336

[45] Date of Patent: Jun. 11, 1996

[54] DUAL HANDLE INSERTING MACHINE

[76] Inventor: Joseph R. Gibas, 244 W. Willow Ave., West Covina, Calif. 91790

[21] Appl. No.: 245,434

[22] Filed: May 18, 1994

[51] Int. Cl.[6] ..... B23P 21/00

[52] U.S. Cl. ..... 29/774; 29/789; 29/809; 53/48.1; 53/398

[58] Field of Search ..... 29/774, 789, 790, 29/809, 235; 53/48.1, 48.3, 48.4, 48.5, 398

[56] References Cited

U.S. PATENT DOCUMENTS

| | | | |
|---|---|---|---|
| 2,936,558 | 5/1960 | Glazer . | |
| 3,381,452 | 5/1968 | Gentry et al. . | |
| 3,452,508 | 7/1969 | Dzenis . | |
| 3,509,684 | 5/1970 | Hohl et al. . | |
| 3,714,756 | 2/1973 | MacInnes et al. . | |
| 3,859,773 | 1/1975 | Calvert et al. . | |
| 3,877,196 | 4/1975 | Vergobbi | 53/398 |
| 3,977,150 | 8/1976 | Culpepper | 53/48.1 |
| 4,281,502 | 8/1981 | Bonkowski . | |
| 4,503,657 | 3/1985 | Osteen . | |

FOREIGN PATENT DOCUMENTS

| | | | |
|---|---|---|---|
| 31992 | 7/1981 | European Pat. Off. | 53/48.1 |

OTHER PUBLICATIONS

Sample Handle by Int'l Omni Pac of Glendora, California.

*Primary Examiner*—David P. Bryant
*Attorney, Agent, or Firm*—Christie, Parker & Hale

[57] ABSTRACT

A machine for attaching handles to pairs of containers. The machine has a handle reservoir fixture for retaining a stack of handles adjacent to a container flow path. A vertically moveable handle insertion fixture is located above the container flow path for receiving a handle from the stack, delivering the handle to a pair of containers and securing the handle about neck of the containers. A pusher delivers the handle from the stack to the handle insertion fixture.

13 Claims, 8 Drawing Sheets

DUAL HANDLE INSERTING MACHINE

FIELD OF THE INVENTION

The invention pertains to the bottling industry. More particularly, the invention pertains to the attachment of handles to pairs of milk jug-type containers to allow each pair to be carried as an individual unit.

BACKGROUND OF THE INVENTION

Presently, milk and certain other liquids are commonly stored and sold in one half and one gallon plastic jugs. A typical jug is formed of high density polyethylene by a blow molding process such as disclosed in U.S. Pat. No. 4,272,233 by Donald D. Cochran and issued Jun. 9, 1981. To provide convenient carrying means for pairs of such jugs, a number of handles have been devised. In two particular handles manufactured by International omni Pac of Glendora, Calif. and OPI, Inc. of Eugene Oreg., respectively, a pair of coplanar rings are formed at opposite ends of an elongate central gripping portion. To secure the handle to the jugs, each ring is snapped over an approximately annular lip about the neck of a jug. A series of fingers projecting upward and inward from each of the rings engages the rim so that the handle can support the weight of the jug.

In a typical bottling plant, the milk jugs are ultimately placed in milk crates. The crates typically hold four or six jugs in a two by two or two by three orientation.

SUMMARY OF THE INVENTION

There is accordingly provided in practice of a preferred embodiment of the present invention a dual handle inserting machine having a handle reservoir fixture for retaining a stack of handles adjacent to a container flow path.

A vertically moveable handle insertion fixture is located above the container flow path for receiving a handle from the stack, delivering the handle to a pair of containers and securing the handle about neck of the containers. A pusher moves horizontally to deliver the handle from the stack to the handle insertion fixture.

In the illustrated embodiment, the machine is configured for use with milk jugs contained in a two by three orientation in a milk crate. Accordingly, three parallel handle stacks are provided and an individual pusher is associated with each stack.

BRIEF DESCRIPTION OF THE DRAWINGS

The features of the specific embodiment of the best mode contemplating of carrying out the invention are illustrated in the drawings, in which.

DETAILED DESCRIPTION

Figure 1:
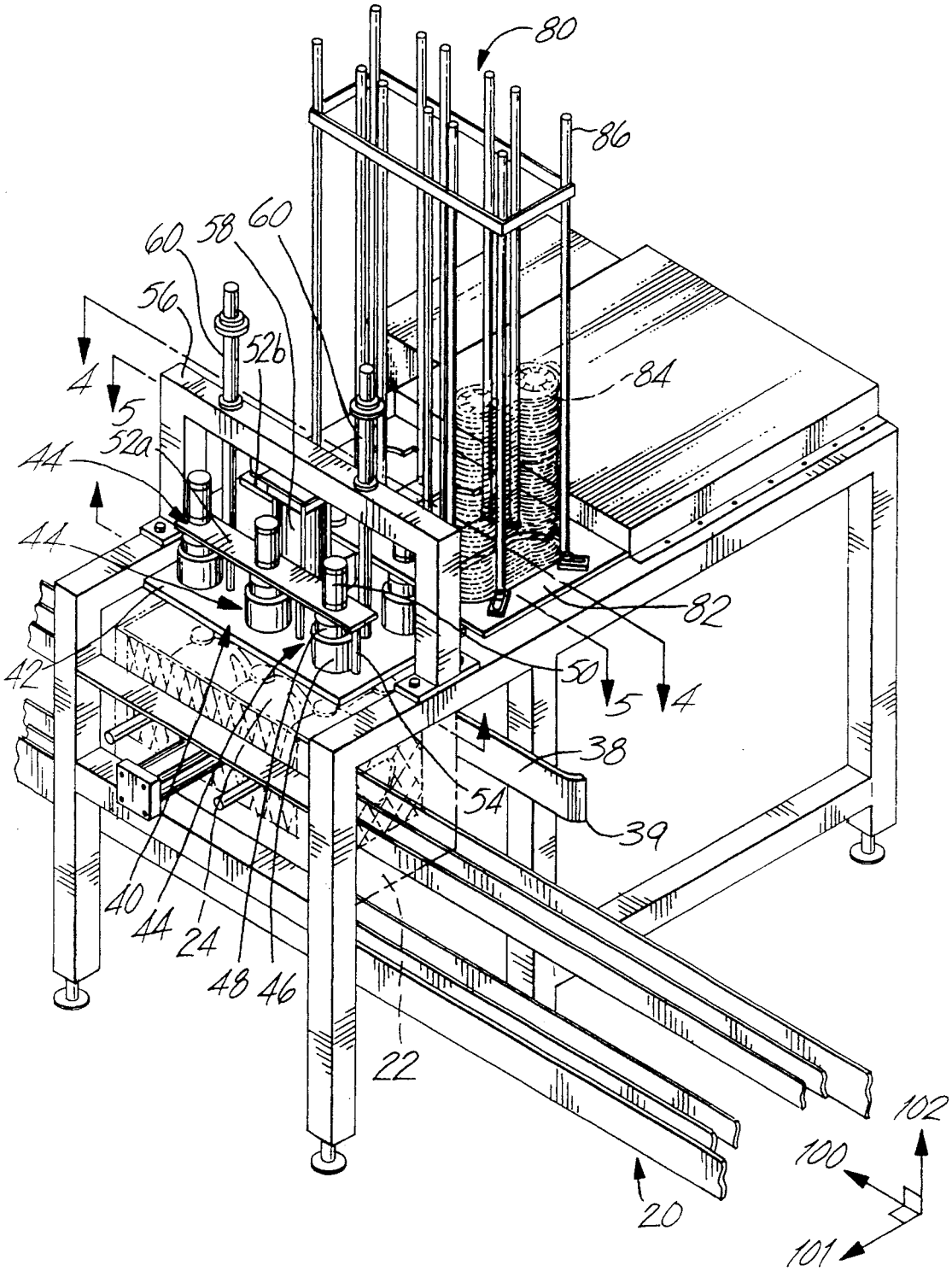
FIG. 1 is an isometric view of a dual handle insertion machine according to principles of the present invention.

A dual handle insertion machine is shown associated with a conveyor system 20 for transporting milk crates 22, each crate containing six one-gallon plastic milk jugs 24. The conveyor system is of any suitable powered or gravity-operated type. As shown in FIG. 1, a milk crate 22 moves along the conveyor system 20 in a downstream direction 100 until it reaches the dual handle insertion machine. For purposes of exposition, the directions orthogonal to the downstream direction are designated the forward direction 101 and upward direction 102.

When the milk crate reaches a work position shown in FIG. 1, its downstream motion is interrupted by a stop member 26 (FIGS. 2 & 3) which is inserted into the flow path of the milk crate driven by a pneumatic cylinder 28. The stop member is in the form of a flat elongate bar extending horizontally from forward to back adjacent the downstream end of the machine. The cylinder 28 drives the bar forward to insert the bar into the flow path of the milk crate where its downstream surface contacts the leading (upstream) side of the crate. A ram 30 (FIG. 3) is extended in a backward direction (toward the rear of the machine) to engage the forward face of the milk crate.

The ram is driven by a pneumatic cylinder 32 mounted to a cross-member 34 (FIG. 2) at the front of the machine. A pair of guide rods 36 at either side of the pneumatic cylinder 32 extend through the cross-member 34 and are secured to the forward face of the ram so as to maintain the orientation of the ram as it is moved. The action of the ram 30 forces the milk crate backward to securely engage a rear guide 38 (FIG. 1) formed by an elongate bar or plate mounted to the machine immediately to the rear of the flow path. The upstream end 39 of the rear guide may be bent or flared to the rear so as to help guide milk crates into the machine. A similar guide may be mounted to the front of the machine to compliment the ram.

The work position is thus determined by the stop member and the rear guide. In the work position, the milk crate is positioned directly under a handle insertion fixture 40. The handle insertion fixture comprises a horizontal base plate 42 (FIG. 1) and six handle insertion devices 44 arranged in three pairs of front and back devices positioned from upstream to downstream. Each pair is located directly above a pair of milk jugs to which a handle is to be attached.

Each handle insertion device has an annular sleeve 46 (FIG. 1) oriented vertically and secured to the base plate 42. A cylindrical piston 48 is vertically movable within the sleeve 46 and through a hole the plate. The piston movement is controlled by a pneumatic cylinder 50. The pneumatic cylinders of the front and back handle insertion devices of each pair are held at a fixed distance above the plate by front and back horizontal support bars **52*a* and 52*b*, respectively on legs 54**.

Figure 2:
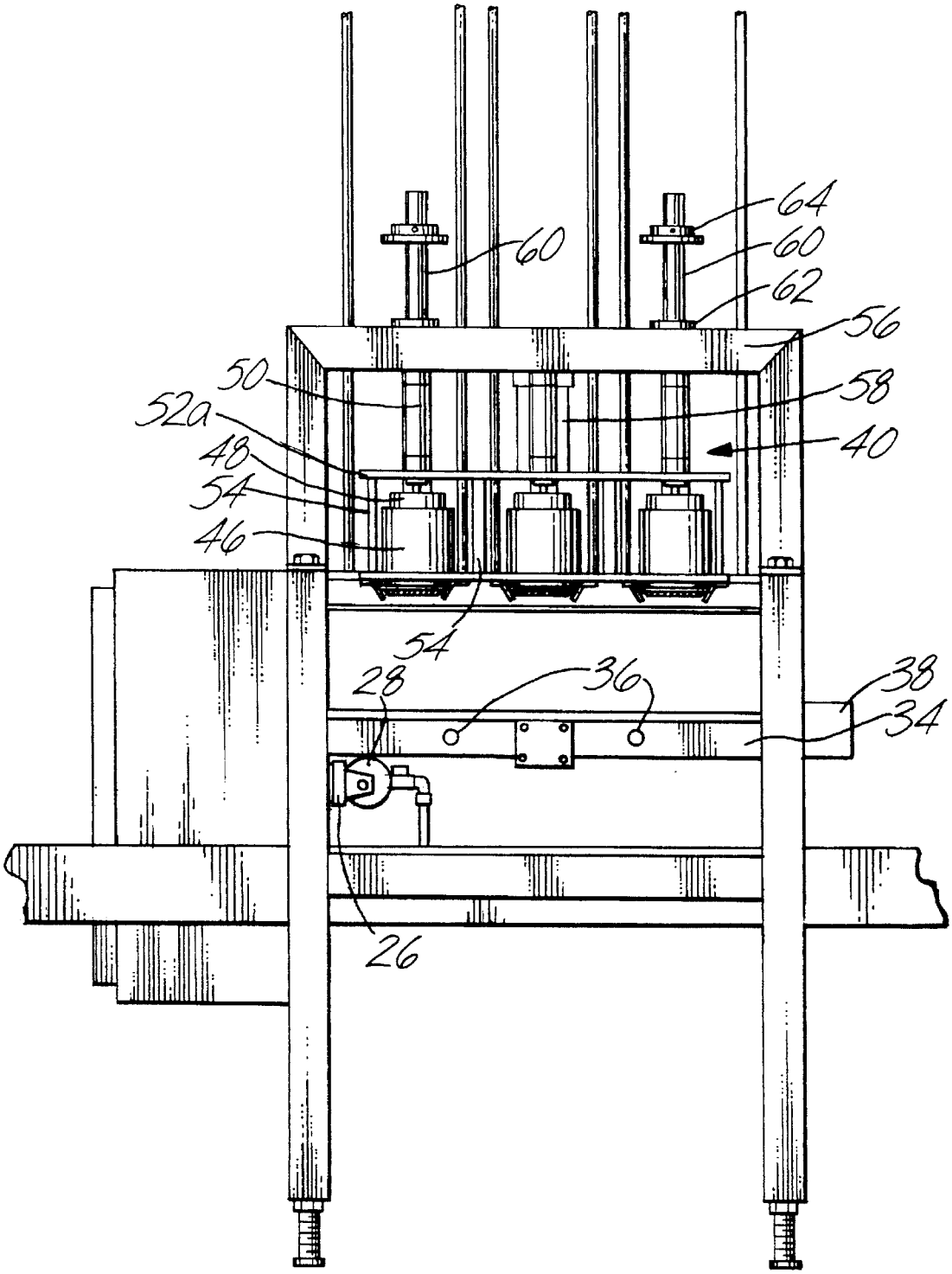
FIG. 2 is a front elevational view of the machine of FIG. 1.
Figure 3:
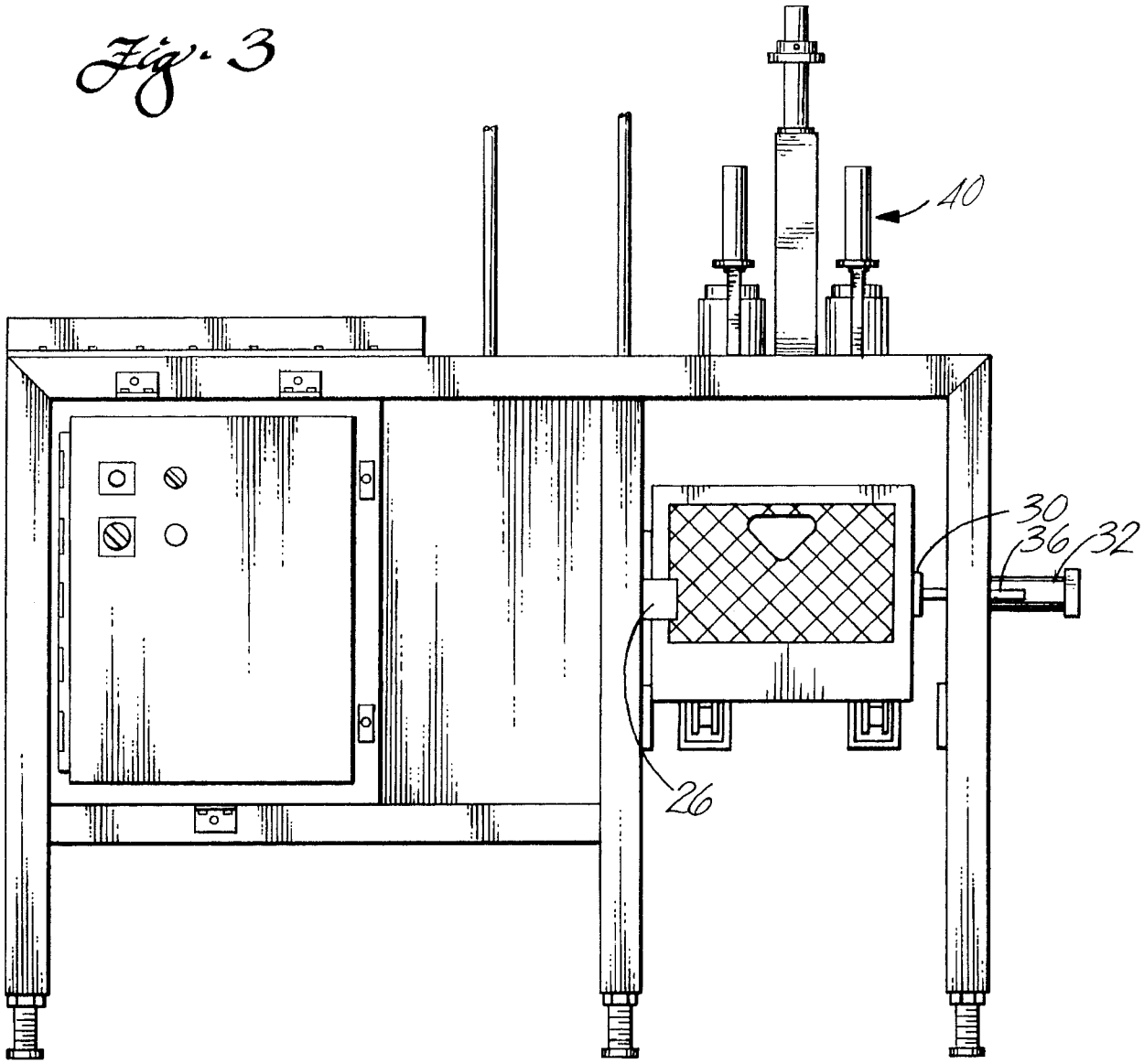
FIG. 3 is an upstream side elevational view of the machine of FIG. 1.
Figure 7:
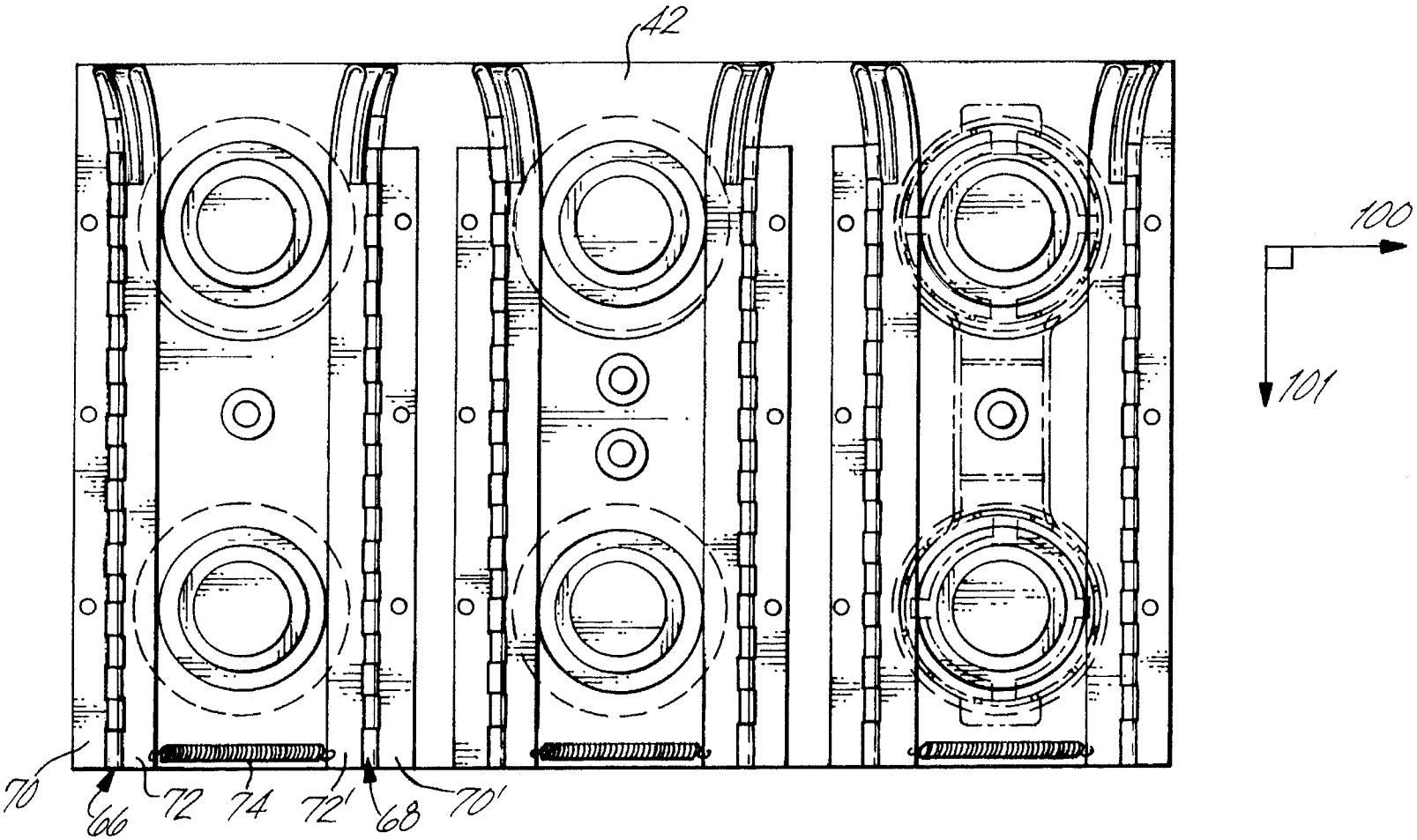
FIG. 7 is a bottom elevational view of the handle insertion fixture portion of the machine of FIG. 1, taken along line 7—7.
Figure 9:
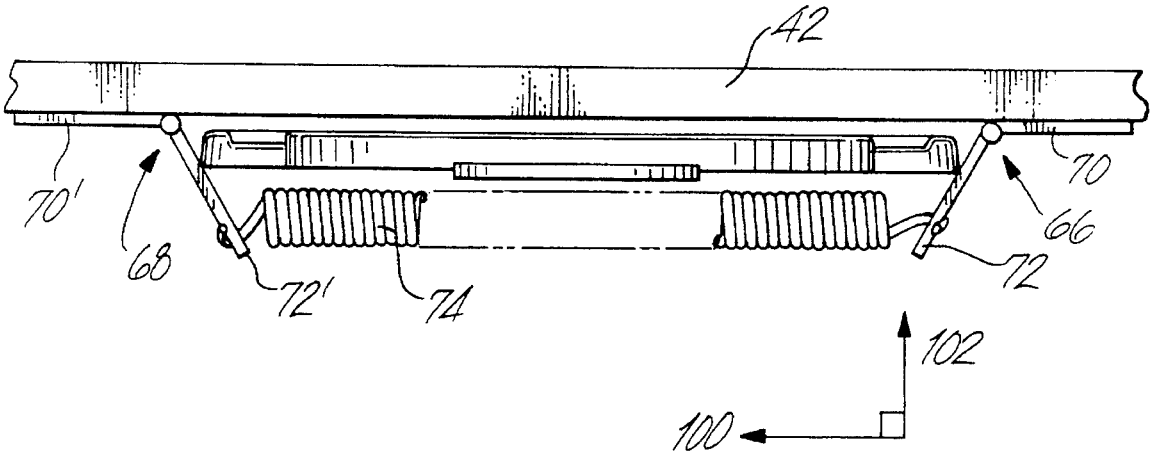
FIG. 9 is an enlarged front elevational view of a handle guide portion of the handle insertion fixture of the machine of FIG. 2.

The handle insertion fixture is itself vertically movable, suspended from a bridge 56 by a pneumatic cylinder system 58 and guided by a pair of vertical guide rods 60 extending through bushings 62 in the bridge and secured to the base plate 42. A stop collar 64 is secured to each guide rod 60 adjacent its upper end for limiting downward travel of the handle insertion fixture. As shown in FIGS. 2, 7 and 9, on the underside of the base plate 42, below each pair of handle insertion devices are a pair of upstream and downstream hinged handle guides 66 and 68, respectively, oriented perpendicular to the crate flow path and formed of piano hinge stock. Each handle guide has a fixed outboard portion 70, 70' which is screwed to the underside of the plate and a movable portion 72, 72'. At their rear ends, the movable portions are flared outward (away from the opposite guide of the pair). At their front ends, each movable portion is connected to the movable portion of the other guide of the pair by an extension spring 74.

Figure 4:
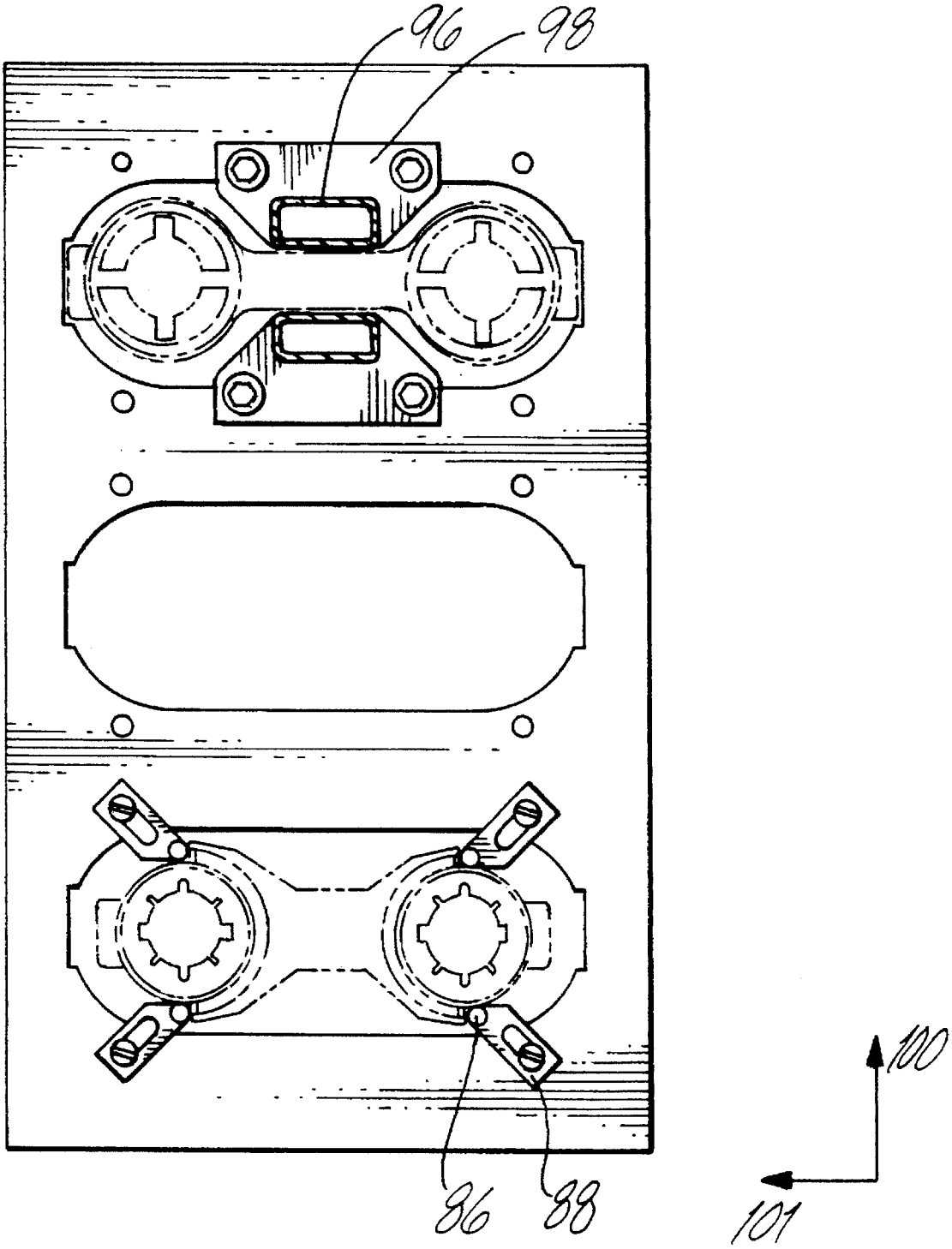
FIG. 4 is a top elevational view of a handle reservoir fixture portion of the machine of FIG. 1, taken along line 4—4.

As shown in FIG. 1, immediately behind the handle insertion fixture and adjacent the container flow path is a handle reservoir fixture 80 for retaining stacks 84 of handles. The base 82 of the handle reservoir fixture is formed by a horizontal plate having three ports, each port aligned with a handle insertion device pair and sized to accommodate a handle. A stack 84 of handles is held above each port. Shown in FIG. 4 with regard to the upstreammost port, four vertical rods 86 are held above each port to retain the stack of handles in a vertical orientation. The rods are welded to slotted clips 88 which are screwed or bolted to the plate. A slot in the clip permits the position of the rod to be controlled to accommodate varying configurations or brands of handles. Shown only in FIG. 4 with regard to the downstreammost port, as an alternative or compliment to the rods, a pair of vertical bars 96 may be secured at either side of the port by a flat foot portion 98. The bars can abut both sides of the neck (gripping) portions of the handles to position and retain the handles.

Figure 5:
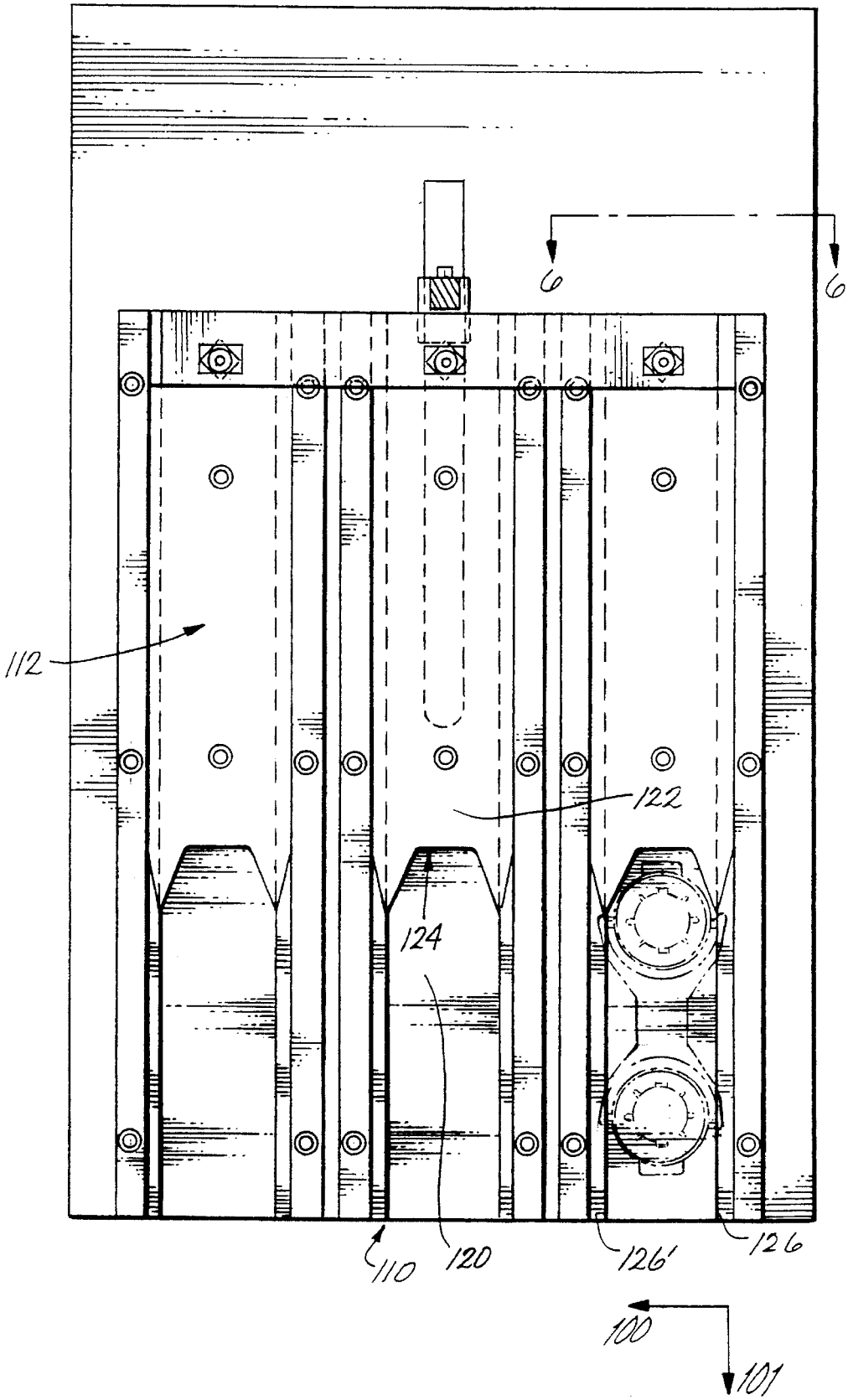
FIG. 5 is a top elevational view of a handle pusher assembly portion of the machine of FIG. 1 taken along line 5—5 as revealed from beneath the handle reservoir fixture portion.
Figure 6:
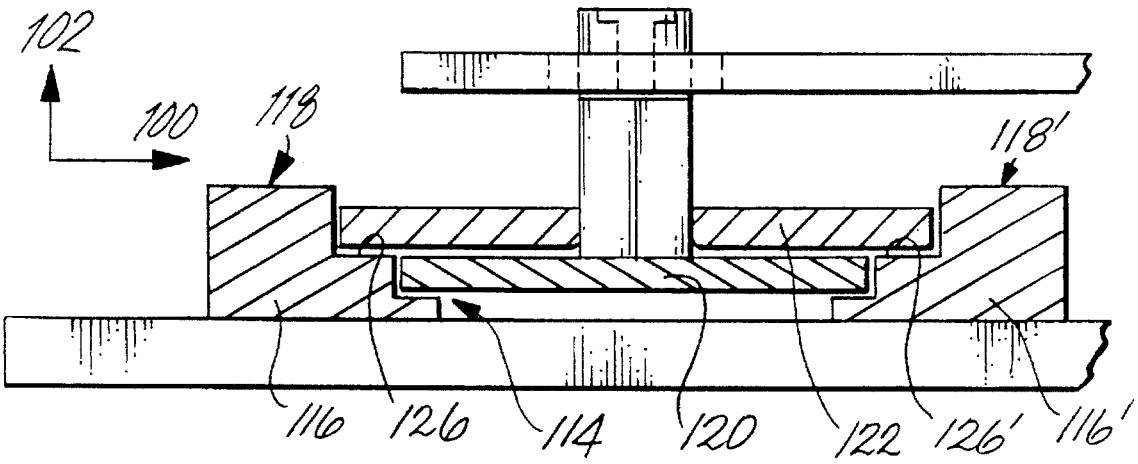
FIG. 6 is a partial rear elevational view of the handle pusher assembly of FIG. 5, taken along line 6—6.

As shown in FIG. 5, a handle pusher assembly 110 is located below the handle reservoir fixture. The pusher assembly has three pushers 112, one associated and aligned with each stack of handles and pair of insertion devices. By means of a pneumatic cylinder (not shown) the three pushers may be moved forward and back as a unit, each pusher riding in a stepped channel 114 (FIG. 6) formed by a pair of guide bars 116, 116' the upper surfaces 118, 118' of which are mounted to the underside of the horizontal plate of the reservoir fixture. To accommodate the stepped channel wall, the pushers are formed in two elongate flat pieces fastened by screws (not shown) to each other, with a narrower lower piece 120 lying below a wider upper piece 122. The upper piece of each pusher has a forward contour having a trapezoidal recess 124 engageable with a handle. A forward portion of each lower pusher piece 120 extends forward of the recess in the upper piece and lies in the channel below the associated handle stack. The lowermost handle in a stack initially lies within the channel directly in front of the upper pusher piece 122, supported by the forward portion of the lower piece and the upper steps 126, 126'.

Initially, the underside of the horizontal base plate 42 of the handle insertion fixture is positioned at the same height as the underside of the base of the handle reservoir fixture 80. With the insertion fixture 40 in this position, it is ready to receive handles from the stacks. To deliver the handles, the pushers are driven forward, pushing the handles along the channels from underneath the base plate of the handle reservoir fixture 80 to underneath the handle insertion fixture 40. As shown in FIGS. 7 and 9, each handle is pushed forward until it lies directly and completely below the handle insertion fixture and is supported by the movable portions of a pair of the guides 66, 68 (opposite sides of the handle supported by opposite guides of the pair). It can be seen that the flared rear ends of the movable portions help direct the handle as it is being pushed forward by the pusher. The guides hold the handles for delivery to the milk jugs. Each extension spring 74 biases its associated guides to support the handle by resisting the tendency of the weight of the handle to open the movable portions of the guides and fall through. It can, additionally, be seen that, as this process occurs, each handle stack is supported by its associated pusher, with the bottom surface of the new lowermost handle in the stack lying on the upper surface of the upper pusher piece 122. Once the handles are in their operative position in the handle insertion fixture, the pushers are retracted so that the new lowermost handle of each stack drops and lies within its associated channel shown and previously described in FIG. 5.

To deliver the handles to the pairs of milk jugs in the crate, the handle insertion fixture is lowered until it reaches its lowest point where the collars 64 mounted to the guide rods which come into contact with the bushings 62.

Figure 8:
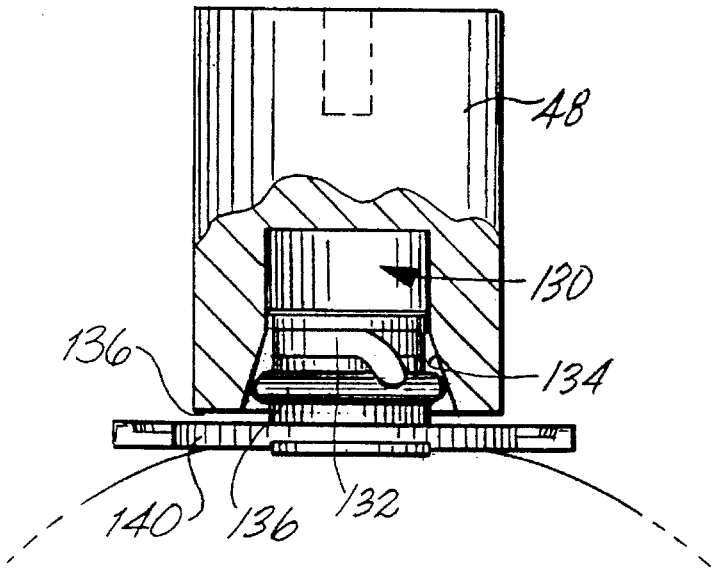
FIG. 8 is a cutaway view of a handle insertion device shown engaged to a milk jug.

At this point, the pistons 48 may be driven downward by the pneumatic cylinders 82 so as to pass through the sleeves 46 and base plate 42 and press the handles over the necks of the milk jugs. As shown in FIG. 8, each piston has a central vertical bore 130 for accommodating the cap 132 of the milk jug 24. At its lowest extremity, the bore has a bevel 134 which serves to both guide the cap into the bore and to accommodate an annular lip 136 about the neck of the jug. The bevel joins an annular bottom face 138 of the piston which is engageable with a ring portion 140 of the handle. It has been observed that a sequential activation of the pistons of the front and rear handle insertion devices in a pair facilitates the insertion of the handle when compared with simultaneous activation. This may be due to the slight tilting of the handle associated with sequential activation. In an exemplary sequence, the rear piston is lowered first to snap the rear ring over the lip of the rear jug. Then, the rear piston is raised as the front piston is lowered to snap the front ring over the lip of the front jug. Thereafter the front piston is raised. Finally, the handle insertion fixture is raised to its initial position for delivery of the next handle.

The action of the pistons in inserting the handle, causes the movable portions 72, 72' of the guides to open against the force of the extension spring and thus ejects or releases the handle from the guides of the handle insertion fixture. The engagement of the ram with the forward face of the crate ensures that the sequential activation of the pistons does not produce unwanted movement of the crate. Additionally, pressure between the ram and the crate helps resist outward expansion of the crate caused by the downward pressure from the pistons on the milk jugs.

After the handles are thus installed and the pistons and the handle insertion fixture raised to their initial positions, the stop and ram are retracted and the milk crate allowed to move downstream along the conveyor system.

The design of the particular pneumatic acuation mechanisms and the associated control system would be a routine matter for one of ordinary skill in the art. Hydraulic, electromechanical and other systems are additionally available. Additionally, the choice of materials for the various elements will be within the skill of the ordinary designer. In the illustrated embodiment, the pusher pieces and stepped guide bars are formed of a phenolic resin and the pistons are formed of an acetal resin. The remaining structural members are preferrably formed of stainless steel wherever possible for purposes of corrosion resistance.

The described embodiment is only considered to be preferred and illustrative of the invented concept. Thus, the scope of the invention is not to be restricted to such embodiment. The machine may be adapted for use with configurations of handles other than those specifically illustrated. Further modifications may be associated with particular features of an individual bottling plan. For example, certain bottling plans may feature conveyor systems in which the crates move in an orientation rotated 90° from that illustrated in the drawing. In such an instance, the handle insertion fixture and pushers may be located above the container flow path with the pushers reciprocating from upstream to downstream. Various and numerous other arrangements may be devised by one skilled in the art without departing from the spirit and scope of the invention.

What is claimed is:

1. A machine for attaching handles to pairs of containers used to store liquid, each of said handles having a pair of coplanar ring portions formed at opposite ends of an elongate central gripping portion, said machine for use with a conveyor system for transporting said pairs of containers along a container flow path from upstream to downstream comprising:

a handle reservoir fixture for retaining a stack of said handles adjacent the container flow path;

a vertically moveable handle insertion fixture located above the container flow path for receiving a handle from said stack, delivering the handle to a pair of said pairs of containers and securing said handle to said pair by snapping said ring portions over lips formed about necks of said pair;

the handle insertion fixture having a first portion for holding the handle for delivery to the pair of containers, said first portion of the handle insertion fixture having a first hinged guide biased to support said handle along a first side of said handle as it is delivered to said pair of containers, and a second portion, vertically moveable relative to the first portion, for ejecting the handle from the first portion and securing it to said pair of containers; and a pusher for delivering the handle from said stack to said handle insertion fixture.

2. The machine of claim 1 wherein the first portion of the handle insertion fixture further comprises a second hinged guide biased to support said handle along a second side of said handle opposite said first side.

3. The machine of claim 2 wherein the first and second guides are connected by an extension spring for biasing the guides to support the handle.

4. The machine of claim 3 wherein the second portion of the handle insertion fixture comprises a pair of cylindrical pistons, each engageable with a corresponding ring portion of said handle and having a central vertical bore for accommodating a cap of a container of said pair of containers.

5. The machine of claim 4 wherein said pair of cylindrical pistons is vertically moveable within a pair of sleeves of the first portion of the handle insertion fixture.

6. The machine of claim 5 wherein a first and a second piston of said pair of cylindrical pistons are sequentially moveable for sequentially securing a first and a second ring portion of said pair of ring portions to a first and a second container of said pair of containers, respectively.

7. The machine of claim 1 wherein said pusher comprises an upper portion and a lower portion, said lower portion extending forward of a forward contour of said upper portion and supporting said handle for delivery from said stack to said handle insertion fixture.

8. The machine of claim 7 wherein the upper pusher portion is formed by a flat elongate upper piece having a recess in said forward contour engageable with said handle and said lower portion is formed by a flat elongate lower piece lying below said upper piece.

9. The machine of claim 8 wherein said lower piece is narrower than said upper piece.

10. The machine of claim 8 wherein said pusher is located below said handle reservoir fixture, said stack alternately supported by said lower and upper pieces of said pusher.

11. The machine of claim 10 wherein said handle reservoir fixture comprises a plurality of vertical elements for retaining said stack in a vertical orientation.

12. The machine of claim 11 wherein said plurality of vertical elements comprises four vertical rods.

13. The machine of claim 11 wherein said plurality of vertical elements comprises two vertical bars for abutting neck portions of handles in said stack.

* * * * *